United States Patent [19]

Manca et al.

[11] Patent Number: 4,820,604

[45] Date of Patent: Apr. 11, 1989

[54] TONER AND DEVELOPER COMPOSITIONS WITH SULFUR COTAINING ORGANOPOLYSILOXANE WAXES

[75] Inventors: Richard D. Manca, Walworth; Angelo J. Barbetta, Penfield, both of N.Y.

[73] Assignee: Xerox Corporation, Stamford, Conn.

[21] Appl. No.: 103,338

[22] Filed: Oct. 1, 1987

[51] Int. Cl.[4] ..... G03G 9/08

[52] U.S. Cl. ..... 430/110; 430/126

[58] Field of Search ..... 430/110, 126

[56] References Cited

U.S. PATENT DOCUMENTS

| | | | |
|---|---|---|---|
| 3,965,022 | 6/1976 | Strong et al. | 430/110 X |
| 3,983,045 | 9/1976 | Jugle et al. | 430/110 |
| 4,064,313 | 12/1987 | Takiguchi et al. | 428/447 |
| 4,142,982 | 3/1979 | Yamakami et al. | 430/110 |
| 4,409,312 | 10/1983 | Ikeda et al. | 430/110 |
| 4,460,672 | 7/1984 | Gruber et al. | 430/110 |
| 4,535,049 | 8/1985 | Honda et al. | 430/110 X |
| 4,640,881 | 2/1987 | Dennis | 430/110 X |

FOREIGN PATENT DOCUMENTS

| | | | |
|---|---|---|---|
| 56-144436 | 11/1981 | Japan | 430/110 |

OTHER PUBLICATIONS

"The Use of a Lubricant in Xerographic Toner to Improve Copy Document Handler Durability", Res. Discl. 25317, May, 1985, p. 227.

*Primary Examiner*—Roland E. Martin
*Attorney, Agent, or Firm*—E. O. Palazzo

[57] ABSTRACT

A toner composition comprised of resin particles, pigment particles, and a sulfur containing organopolysiloxane wax, such as those with (1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas $$\left(\overset{SH}{\overset{|}{R^2}}\right)_c R_d-SiO_{\frac{4-c-d}{2}} \text{ and } {}_{\frac{3-d}{2}}\overset{R_d}{\overset{|}{O}}Si-R^2-S-S-R^2-\overset{R_d}{\overset{||}{Si}}O_{\frac{3-d}{2}} \text{ and}$$

(3) from 0 to 96 mole percent of siloxane units have the formula $$R_eSiO_{\frac{4-e}{2}}$$

where R is a monovalent hydrocarbon radical having from 1 to 10 carbon atoms, $R^1$ is an alkyl radical linked to silicon with an SiC-bond which has at an average of least 25 carbon atoms, $R^2$ is a multivalent radical selected from a hydrocarbon radical having from 2 to 10 carbon atoms and which radical is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+bis 1,2 or 3, and and the sum of c+d is 1,2 or 3.

31 Claims, No Drawings

TONER AND DEVELOPER COMPOSITIONS WITH SULFUR COTAINING ORGANOPOLYSILOXANE WAXES

BACKGROUND OF THE INVENTION

This invention is generally directed to toner and developer compositions, and more specifically the present invention is directed to toner compositions, including magnetic single component, and colored toner compositions with certain waxes. In one embodiment of the present invention, the toner compositions are comprised of resin particles, pigment particles, and sulfur containing organopolysiloxane waxes. There are also provided in accordance with the present invention positively charged toner compositions comprised of resin particles, pigment particles, sulfur containing organopolysiloxane and charge enhancing additives. In addition, the present invention is directed to developer compositions comprised of the aforementioned toners and carrier particles. Furthermore, in another embodiment of the present invention there are provided single component toner compositions comprised of resin particles, magnetic particles such as magnetites, and organopolysiloxane waxes. The toner and developer compositions of the present invention are useful in electrophotographic imaging systems, especially those systems wherein the use of silicone oils are avoided.

Developer and toner compositions with certain waxes therein are known. For example, there are disclosed in U.K. Patent Publication No. 1,442,835, the disclosure of which is totally incorporated herein by reference, toner compositions containing resin particles and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, U.K. Patent publication No. 1,442,835 discloses the addition of paraffin waxes together with, or without a metal salt of a fatty acid, reference page 2, lines 55 to 58. Also, many patents disclose the use of metal salts of fatty acids for incorporation into toner compositions, such as U.S. Pat. No. 3,655,374.

Further, there is illustrated in Japanese Publication Abstract No. 130036/78 the incorporation of silicone resins into toners; while Japanese Patent Publication Abstract No. 48243/79 discloses the inclusion of silicone oils in toner compositions. Moreover, there are illustrated in Japanese Publication Abstract Nos. 52,640; 55,954; 130,048; and 60,754 toners with silicone oils that enable the substantial elimination of offsetting. Furthermore, patents of background interest include U.S. Pat. No. 4,214,549, the disclosure of which is totally incorporated herein by reference, relating to the selection of functional silicones with a Viton fuser roll, U.S. Pat. Nos. 4,064,313; 4,142,982; 4,075,362; 4,287,280; 4,469,750; 4,142,982; and 4,515,884. Also, disclosed in U.S. Pat. No. 3,346,405 are mercaptoalkyl substituted organopolysiloxanes, while U.S. Pat. No. 3,565,937 describes a method for preparing mercaptoalkyl organo silanes in which a silicon hydride group is added across the double bond of a sulfur substituted olefin. Other patents with similar disclosures include U.S. Pat. Nos. 3,388,144 and 4,046,795. None of the aforementioned prior art, however, illustrates toner compositions with the novel organopolysiloxanes described herein, which toners are especially useful in electrostatic imaging systems wherein certain fuser rolls are selected, and wherein no silicone oils are needed.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and U.S. Pat. No. 4,298,672, the disclosure of which is totally incorporated herein by reference, positively charged toner compositions containing resin particles and pigment particles, and as a charge enhancing additive alkyl pyridinium compounds inclusive of cetyl pyridinium chloride. Other representative prior art disclosing positively charged toner compositions with charge enhancing additives include U.S. Pat. Nos. 3,944,493; 4,007,293; 4,079,014; and 4,394,430.

Although the above described toner and developer compositions are useful for their intended purposes, there is a need for improved compositions. More specifically, there is a need for toner compositions, including single component and colored compositions which possess advantages not achievable with many of the prior art compositions. There is also a need for toner compositions with certain waxes that are particularly useful in electrostatic imaging processes wherein the use of silicone oils are avoided, and offsetting is substantially eliminated. In addition, there is a need for toner and developer compositions that maintain their electrical characteristics for extended time periods exceeding, for example, 500,000 imaging cycles. There is also a need for toner and developer compositions that retain their conductivity characteristics for extended time periods. In addition, there is a need for toner and developer compositions useful in electrophotographic imaging processes wherein Viton and/or silicone fuser rolls are selected, and silicone oil release fluids are avoided therewith. Furthermore, there is a need for single component toners, and colored toners that possess many of the aforementioned characteristics. Also, there is a need for toner and developer compositions with certain fusing temperature latitudes.

SUMMARY OF THE INVENTION

It is an object of the present invention to provide toner and developer compositions with certain organopolysiloxane waxes.

Another object of the present invention resides in the provision of toner and developer compositions with stable electrical characteristics.

In another object of the present invention there are provided toner and developer compositions that enable the elimination of silicone oils and the accompanying devices in electrophotographic imaging systems.

Furthermore, in another object of the present invention there are provided toner and developer compositions containing specific sulfur organopolysiloxane waxes.

Moreover, another object of the present invention relates to the provision of toner and developer compositions that enable the substantial elimination of toner offsetting.

Additionally, in yet another object of the present invention there are provided toner and developer compositions with certain sulfur containing organopolysiloxane waxes therein or thereon that enable images with excellent resolution, and that possess the other advantages as illustrated herein.

In another object of the present invention there are provided positively charged toner compositions with sulfur organopolysiloxane waxes therein or thereon which are useful for causing the development of electrostatic latent images, including color images.

In yet another object of the present invention there are provided single component toner compositions with sulfur containing organopolysiloxane waxes therein or thereon.

In a further object of the present invention there are provided colored toner and developer compositions with organopolysiloxane waxes therein.

Additionally, in still another object of the present invention there are provided methods for the development of images, including colored images in elecrophotographic imaging systems, especially those containing therein Viton or silicone fuser rolls, and wherein offset preventing oils such as silicone are avoided.

These and other object of the present invention are accomplished by providing developer compositions and toner compositions comprised of resin particles, pigment particles, and certain waxes. More specifically, the present invention is directed to toner compositions comprised of resin particles, pigment particles inclusive of magnetites, and sulfur containing organopolysiloxane waxes. In one embodiment of the present invention, there are provided toner compositions comprised of resin particles, pigment particles, and sulfur containing organopolysiloxane waxes of the following formula, which waxes, and processes for the preparation thereof are illustrated in Stauffer-Wacker Silicones Corporation application U.S. Ser. No. 945,124, Martin et al., entitled Sulfur Containing Organopolysiloxane Waxes, and A Method For Preparing the Same, the dislosure of which is totally incorporated herein by reference.

(1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas $$R_d-\overset{\left(\overset{SH}{\overset{|}{R^2}}\right)_c}{\overset{|}{Si}}O_{\frac{4-c-d}{2}} \text{ and } \frac{3-d}{2}\ O\overset{R_d}{\overset{|}{Si}}-R^2-S-S-R^2-\overset{R_d}{\overset{\|}{Si}}O_{\frac{3-d}{2}} \text{ and}$$

(3) from 0 to 96 mole percent of siloxane units of the formula $$R_eSiO_{\frac{4-e}{2}}$$

where R is a monovalent hydrocarbon radical having from 1 to 10 carbon atoms, $R^1$ is an alkyl radical linked to silicon with an SiC-bond, and which has at an average of least 25 carbon atoms, $R^2$ is a multivalent radical selected from a hydrocarbon radical having from 2 to 10 carbon atoms and which is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and the sum of c+d is 1, 2 or 3.

Furthermore, there are provided in accordance with the present invention positively charged toner compositions comprised of resin particles, pigment particles, the aforementioned sulfur containing organopolysiloxane waxes, and charge enhancing additives. Another embodiment of the present invention is directed to developer compositions comprised of the aforementioned toners and carrier particles.

Preferred sulfur containing organopolysiloxane waxes selected for the toner and developer compositions of the present invention contain (1) from about 3 to about 99, and more preferably from 5 to 99 mole percent of siloxane units of the formula $$R_a-\overset{(R^1)_b}{\overset{|}{Si}}O_{\frac{4-a-b}{2}}$$

(2) from 1 to 97 mole percent of siloxane units selected from the components represented by the following formulas $$R_d-\overset{\left(\overset{SH}{\overset{|}{R^2}}\right)_c}{\overset{|}{Si}}O_{\frac{4-c-d}{2}} \text{ and } \frac{3-d}{2}\ O\overset{R_d}{\overset{|}{Si}}-R^2-S-S-R^2-\overset{R_d}{\overset{\|}{Si}}O_{\frac{3-d}{2}} \text{ and}$$

(3) from 0 to 96 mole percent of siloxane units of the formula $$R_eSiO_{\frac{4-e}{2}}$$

where R, $R^1$, $R^2$, a, b, c, d and e are as defined herein.

The sulfur containing organopolysiloxane waxes of this invention are prepared by reacting an alkyl functional silane of the formula $$R_a\overset{(R^1)_b}{\overset{|}{Si}}(R^3)_{4-a-b}$$

with a mercaptosilane of the formula $$R_dSi-(R^3)_{4-c-d}\left(\begin{array}{c}SH\\|\\R^2\end{array}\right)_c$$

in the presence of water and solvent, in which R, $R^1$, $R^2$, a, b, c and d are as defined herein, and $R^3$ is a hydrocarbonoxy radical (OR) having up to 10 carbon atoms, or a halogen, such as chlorine, bromine, or iodine. When $R^3$ is a hydrocarbonoxy radical, then an acid catalyst having a pKa value of less than 1 is also utilized in the process.

Other silicone compounds which may be employed in the reaction are cyclic trisiloxanes of the formula $$(R_2SiO)_3$$

and/or organodisiloxanes of the formula $$(R_3Si)_2O$$

where R is as defined herein.

Examples of the various radicals, specific examples of reactants, and other information relating to the sulfur containing organopolysiloxane waxes, which waxes are available from Stauffer-Wacker Silicones Corporation, are illustrated in the reference copending U.S. Ser. No. 945,124, the disclosure of which has been totally incorporated herein by reference.

Illustrative examples of suitable toner resins selected for the toner and developer compositions of the present invention, and present in various effective amounts, such as for example from about 70 percent by weight to about 95 percent by weight, include polyamides, epoxy resins, polyurethanes, diolefins, vinyl resins and polymeric esterification products of a dicarboxylic acid, and a diol comprising a diphenol. Any suitable vinyl resin may be selected as the toner resin including homopolymers or copolymers of two or more vinyl monomers. Typical vinyl monomeric units include styrene, p-chlorostyrene vinyl naphthalene unsaturated monoolefins such as ethylene, propylene, butylene, isobutylene, and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide, vinyl ethers, such as vinyl methyl ether, vinyl isobutyl ether, and vinyl ethyl ether, and N-vinyl indole, and N-vinyl pyrrolidone; styrene butadiene copolymers, especially styrene butadiene copolymers prepared by a suspension polymerization process, reference U.S. Pat. No. 4,558,108, the disclosure of which is totally incorporated herein by reference; styrene butadiene copolymers prepared by an emulsion polymerization process, reference U.S. Pat. No. 4,469,770, the disclosure of which is totally incorporated herein by reference; and mixtures thereof.

As preferred toner resins there can be selected the esterification products of a dicarboxylic acid and a diol comprising a diphenol, reference U.S. Pat. No. 3,590,000, the disclosure of which is totally incorporated herein by reference. Other preferred toner resins included styrene/methacrylate copolymers and styrene/butadiene copolymers, especially those as illustrated in the aforementioned patents, and Pliolites available from Goodyear Chemical Company, polyester resins obtained from the reaction of bisphenol A and propylene oxide, followed by the reaction of the resulting product with fumaric acid, branched polyester resins resulting from the reaction of dimethylterephthalate, 1,3-butanediol, 1,2-propanediol and pentaerythritol, crosslinked styrene methacrylates, and the like.

Numerous well known suitable pigments or dyes can be selected as the colorant for the toner particles including, for example, carbon black, nigrosine dye, aniline blue, phthalocyanine derivatives, magnetites and mixtures thereof. The pigment, which is preferably carbon black, is present in a sufficient amount to render the toner composition colored in order that they will permit the formation of a clearly visible image. Generally, the aforementioned pigment particles are present in amounts of from about 3 percent by weight to about 20 percent by weight, based on the total weight of the toner composition; however, lesser or greater amounts of pigment particles can be selected providing the objectives of the present invention are achieved. Mixtures of magnetites and the aforementioned pigments can also be selected, which mixtures contain, for example, from about 15 to about 35 percent by weight of magnetites, and from about 3 to about 15 percent by weight of pigment particles.

When the pigment particles are comprised of magnetites, thus enabling single component toner compositions which are a mixture of iron oxides ($FeO.Fe_2O_3$) including those commercially available as Mapico Black, these pigments are present in the toner composition in an amount of from about 10 percent by weight to about 70 percent by weight, and preferably in an amount of from about 20 percent by weight to about 50 percent by weight.

Also included within the scope of the present invention are colored toner compositions containing as pigments or colorants, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone, and anthraquinone dye identified in the Color Index as Cl 60710; Cl Dispersed Red 15, a diazo dye identified in the Color Index as Cl 26050; Cl Solvent Red 10; Lithol Scarlet; Hostaperm; and the like. Illustrative examples of cyan materials that may be used as pigments include copper tetra-4(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; Sudan Blue; and the like; while illustrative examples of yellow pigments that may be selected include diarylide yellow 3,3-dichlorobenzidene acetoacetanilides, a monazo pigment identified in the Color Index as Cl 12700; Cl Solvent Yellow 16, a nitrophenyl amine sulfonamide identified in the Color Index as Foron Yellow SE/GLN; Cl Dispersed Yellow 33; 2,5-dimethoxy-4-sulfonanilide phenylazo-4'-chloro-2,5-dimethoxy aceto-acetanilide; Permanent Yellow FGL; and the like. These pigments are generally present in the toner composition in an amount of from about 2 weight percent to about 15 weight percent based on the weight of the toner resin particles.

Illustrative examples of charge enhancing additives present in the toner in various effective amounts such as, for example, from 0.1 to about 15 percent by weight, include alkyl pyridinium halides, such as cetyl pyridinium chlorides, reference U.S. Pat. No. 4,298,672, the disclosure of which is totally incorporated herein by reference; dimethyl ammonium ethyl sulfate, cetyl pyridinium tetrafluoroborates, quaternary ammonium sulfate and sulfonate charge control agents as illustrated in U.S. Pat. No. 4,338,390; the disclosure of which is totally incorporated herein by reference; stearyl phenethyl dimethyl ammonium tosylates, reference U.S. Pat. No. 4,338,390, the disclosure of which is totally incorporated herein by reference; and other known similar charge enhancing additives providing the objectives of the present invention are accomplished; and the like.

An important component for the compositions of the present invention is the sulfur containing organopolysiloxane waxes of, for example, the formula as illustrated herein. These waxes, which are available from Stauffer-Wacker Silicones Corporation, are generally present in the toner in an effective amount of, for example, from about 2 to about 10 percent by weight. Generally, however, the aforementioned waxes can be present in various effective amounts such as, for example, from about 1 to about 20 percent by weight.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles, which are positively charged, to adhere to and surround the carrier particles. Illustrative examples of carrier particles that may be selected include granular zircon, granular silicon, glass, steel, nickel, iron, ferrites, silicon dioxide, and the like. Additionally, there can be selected as carrier particles nickel berry carriers as described in U.S. Pat. No. 3,847,604, the disclosure of which is totally incorporated herein by reference, which carriers are comprised of nodular carrier beads of nickel characterized by surfaces of reoccurring recesses and protrusions thereby providing particles with a relatively large external area. Preferred carrier particles selected for the present invention are illustrated in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel core with a coating thereover of a vinyl chloride/trifluorochloroethylene copolymer, which coating contains therein conductive particles such as carbon black. Other coatings include fluoropolymers, such as polyvinylidene fluoride resins, poly(-chlorotrifluoroethyl), fluorinated ethylene and propylene copolymers; terpolymers of styrene; methylmethacrylate, and a silane such as triethoxy silane, reference U.S. Pat. Nos. 3,467,634 and 3,526,533, the disclosures of which are totally incorporated herein by reference; polytetrafluoroethylene; fluorine containing polyacrylates and polymethacrylates; and other known coatings. There can also be selected as carrier coatings those as illustrated in copending application Ser. No. 793,042, entitled Developer Compositions With Coated Carrier Particles, the disclosure of which is totally incoporated herein by reference. More specifically, there are illustrated in the aforementioned copending application carriers comprised of a core with two coatings thereover, which are not in close proximity in the triboelectric series, such coatings including, for example, from about 10 to about 90 percent by weight of Kynar, and from about 90 to 10 percent by weight of polymethyl methacrylate.

Also, while the size of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner composition of the present invention can be prepared by a number of known methods including mechanical blending, and melt mixing the toner resin particles, pigment particles or colorants, other additives, and waxes followed by mechanical attrition. Other methods include those well known in the art such as extrusion processing, spray drying, mechanical dispersion, melt dispersion, dispersion polymerization, and suspension polymerization. In one dispersion polymerization method, a solvent dispersion of the resin particles, the pigment particles, wax, and charge enhancing additive are spray dried under controlled conditions. With further respect to the present invention, the waxes are preferably added as internal additives, that is together with the other toner components. More specifically, the sulfur containing waxes illustrated herein are incorporated as an internal additive by formulating the toner composition with a process that comprises the mixing and melt blending of resin particles, pigment particles, and wax. In another embodiment of the present invention, the sulfur containing waxes can be utilized as external additives, that is they can be added subsequent to the formation of the toner composition.

In addition, the toner and developer compositions of the present invention may be selected for use in developing images in electrophotographic imaging systems containing therein, for example, conventional photoreceptors, such as selenium and selenium alloys. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines; while examples of charge transport layers include the diamines as disclosed in U.S. Pat. No. 4,265,990. Other photoresponsive devices useful in the present invention include polyvinyl carbazole 4-dimethylaminobenzylidene; 2-benzylideneamino-carbazole; 4-dimethamino-benzylidine; (2-nitro-benzylidene)-p-bromoaniline; 2,4-diphenyl-quinazoline; 1,2,4-triazine;

1,5-diphenyl-3-methyl pyrazoline 2-(4'-dimethylamino phenyl)-benzoaxzole; 3-aminocarbazole; hydrazone derivatives; polyvinyl carbazoletrinitrofluorenone charge transfer complex; and mixtures thereof. Moreover, there can be selected as photoconductors hydrogenated amorphous silicon, squaraines, perylenes, and the like.

The following examples are being submitted to further define various species of the present invention. These examples are intended to illustrate and not limit the scope of the present invention. Also, parts and percentages are by weight unless otherwise indicated.

EXAMPLE I

A mercaptopolysiloxane copolymer is prepared by Stauffer-Wacker Silicones Corporation by adding to a reactor equipped with a stirrer, condenser, thermometer and moisture trap, 75 parts of a silane of the formula $$C_nH_{2n+1}Si(OCH_3)_3$$

where n has an average value of 45, to a reactor containing 6.5 parts of 3-mercaptopropyl trimethoxysilane, 12.4 parts of hexamethylcyclo trisiloxane, 5.9 parts of hexamethyl disiloxane, and 100 parts of heptane and then heating the reactants to a temperature of 61° C. About 81.5 parts of water and 2 parts of acid clay (available from Filtrol Corporation as Filtrol-13) are then added to the reactor. The reactants are heated to a temperature of about 150° C. while removing the aqueous portion of the azeotrope. The contents of the reactor are cooled to about 50° C., then about 10 parts of celite are added, and the mixture filtered.

The filtrate is then vacuum stripped up to 125° C. at less than 1 Torr. The resultant wax melts at 58° C. and has an SH content of 0.05 weight percent.

EXAMPLE II

To a reactor equipped with a stirrer, condenser, thermometer and moisture trap are added 75 parts of a silane of the formula $$C_nH_{2n+1}Si(OCH_3)_3$$

where n has an average value of 45, 70 parts of 3-mercaptopropyl trimethoxysilane, 12.4 parts of hexamethylcyclo trisiloxane, 5.9 parts of hexamethyl disiloxane, and 100 parts of heptane, and then heated to 67° C. About 100 parts of water and 7 parts of acid clay (available from Filtrol Corporation as Filtrol no. 13) are then added. The reactants are heated to a temperature of about 150° C. while removing the aqueous portion of the azeotrope. The contents of the reactor are then cooled to about 50° C., then about 10 parts of celite are added, and the mixture filtered. The filtrate is then vacuum stripped up to 145° C. at less than 1 Torr. The resultant wax has an SH content greater than 2 weight percent.

EXAMPLE III

To a reactor equipped with a stirrer, condenser, thermometer and moisture trap are added 75 parts of a silane of the formula $$C_nH_{2n+1}Si(OCH_3)_3$$

where n has an average value of 30, 39 parts of 3-mercaptopropyl trimethoxysilane, 74.4 parts of hexamethylcyclo trisiloxane, 35.4 parts of hexamethyl disiloxane, and 650 parts of heptane. After heating the reactants to a temperature of 70° C., about 489 parts of water and 12 parts of acid clay (available from Filtrol Corporation as Filtrol no. 13) are then added to the reactor. The reactants are heated to a temperature of about 140° C. while removing the aqueous portion of the azeotrope. The contents of the reactor are then cooled to about 50° C., then about 10 parts of celite are added, and the mixture filtered. The filtrate is then vacuum stripped up to 150° C. at less than 1 Torr. The resultant wax has a melting point range of from 44° to 74° C. and contains about 0.6 weight percent SH.

EXAMPLE IV

A toner composition prepared by an extrusion process contained 74 percent by weight of a styrene butadiene copolymer prepared by the suspension polymerization process as illustrated in U.S. Pat. No. 4,558,108, the disclosure of which is totally incorporated herein by reference, 16 percent by weight of the magnetite Mapico Black, 4 percent by weight of Regal 330® carbon black, 1 percent by weight of the charge enhancing additive distearyl dimethyl ammonium methyl sulfate, and 5 percent by weight of the sulfur containing organopolysiloxane wax available from Stauffer-Wacker Silicones Corporation as functional polydimethyl siloxane F-705, and prepared in accordance with the process of Example I. Thereafter, the toner was jetted and classified enabling toner particles with an average volume medium diameter of 11 microns. Subsequently, the aforementioned toner, 200 parts by weight, was mixed with carrier particles comprised of a steel core with a first carrier coating, 35 percent by weight, of polyvinylidene fluoride, and a second carrier coating, 65 percent by weight, of polymethyl methacrylate, reference U.S. Ser. No. 793,042, the disclosure of which was previously incorporated herein by reference. The carrier coating weight was 0.7 percent. After mixing the aforementioned formulated developer on a paint shaker for 10 minutes, the triboelectric charge on the toner was 10.9 microcoulombs per gram, the admix rate was 15 seconds, and there were obtained images of excellent resolution with substantially no background deposits and no offsetting to a silicone fuser roll in a xerographic imaging text fixture containing no silicone oil, and wherein the negatively charged imaging member was comprised of an aluminum supporting substrate, a photogenerating layer of trigonal selenium, and a charge transport layer comprised of 55 percent by weight of N,N'-diphenyl-N,N'-bis(3-methylphenyl 1,1'-biphenyl-4,4'-diamine dispersed in 45 percent by weight of the polycarbonate Makralon.

The triboelectric charge on the toner was determined by placing 0.5 gram of the above prepared developer composition in a Faraday Cage, followed by blowing away from the carrier the toner. Usually there is desired toners that have a triboelectric charge thereon of from about 10 to about 20 microcoulombs per gram. Also, by admix is meant the rate at which freshly added toner acquires an acceptable triboelectric charge substantially equivalent to the toner present in the xerographic imaging apparatus. Generally, an acceptable admix rate is between about 15 and about 60 seconds. Moreover, the toner admix rate was determined in a charge spectrograph.

In addition, the electrical stability of the above prepared developer composition was determined by known tone, detone test procedures; and also by observing the resolution of the images obtained from the imaging test fixture. This data and information indicated that the above prepared developer possessed electrical stability for about 1 million copies at which time the test was terminated since images with substantially no background deposits were obtained and no toner offsetting occured on the fuser rolls. Also, the electrical stability, and specifically the triboelectric charge on the toner, remained relatively constant for relative humidities of from about 20 to about 80 percent.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of resin particles, pigment particles, and an effective amount of a sulfur containing organopolysiloxane wax.

2. A toner composition comprised of resin particles, pigment particles, and an effective amount of a sulfur containing organopolysiloxane wax comprised of:

(1) at least three mole percent of siloxane units of the formula $$R_a-\overset{(R^1)_b}{\overset{|}{Si}}O_{\frac{4-a-b}{2}}$$

(2) at least one mole percent of siloxane units selected from the formulas $$R_d-\overset{\left(\overset{SH}{\overset{|}{R^2}}\right)_c}{\overset{|}{Si}}O_{\frac{4-c-d}{2}} \text{ and } {}_{\frac{3-d}{2}}\overset{R_d}{\overset{|}{O}}Si-R^2-S-S-R^2-\overset{R_d}{\overset{\|}{Si}}O_{\frac{3-d}{2}} \text{ and}$$

(3) from 0 to 96 mole percent of siloxane units have the formula $$R_eSiO_{\frac{4-e}{2}}$$

where R is a monovalent hydrocarbon radical having from 1 to 10 carbon atoms, $R^1$ is an alkyl radical linked to silicon with an SiC-bond which has at an average of least 25 carbon atoms, $R^2$ is a multivalent radical selected from a hydrocarbon radical having from 2 to 10 carbon atoms and which radical is free of aliphatic unsaturation, a hydrocarbon ether or a hydrocarbon thioether, a is an integer of from 0 to 2, b is an integer of 1 or 2, c is an integer of 1 or 2, d is an integer of from 0 to 2, e is an integer of from 0 to 3, and the sum of a+b is 1, 2 or 3, and the sum of c+d is 1, 2 or 3.

3. A toner composition in accordance with claim 1 wherein the wax is present as an internal additive.

4. A toner composition in accordance with claim 1 wherein the wax is present as an external additive.

5. A toner composition in accordance with claim 1 wherein the resin particles are selected from the group consisting of polyesters, styrene butadiene copolymers, styrene acrylates, and styrene methacrylate copolymers.

6. A toner composition in accordance with claim 5 wherein the polyester results from the condensation reaction of dimethylterephthalate, 1,3-butanediol, and pentaerythritol.

7. A toner composition in accordance with claim 5 wherein the styrene butadiene copolymer contains 89 percent by weight of styrene, and 11 percent by weight of butadiene.

8. A toner composition in accordance with claim 5 wherein there is selected a suspension polymerized styrene butadiene.

9. A toner composition in accordance with claim 1 wherein the pigment is selected from the group consisting of carbon black, magnetite and mixtures thereof.

10. A toner composition in accordance with claim 1 wherein the pigment is magnetite.

11. A toner composition in accordance with claim 1 wherein the pigment is selected from the group consisting of magenta, cyan, yellow, and mixtures thereof.

12. A toner composition in accordance with claim 1 wherein the toner contains therein a charge enhancing additive.

13. A toner composition in accordance with claim 12 wherein the charge enhancing additive is selected from the group consisting of distearyl dimethyl ammonium methyl sulfate, cetyl pyridinium halides, and stearyl phenethyl dimethyl ammonium tosylate.

14. A toner composition in accordance with claim 1 wherein the sulfur wax is present in an amount of from about 3 to about 5 percent by weight.

15. A toner composition in accordance with claim 1 wherein the wax is uniformly dispersed in the toner composition.

16. A developer composition comprised of the toner composition of claim 1, and carrier particles.

17. A developer composition comprised of the toner composition of claim 2, and carrier particles.

18. A developer composition in accordance with claim 17 wherein the carrier particles are coated.

19. A developer composition in accordance with claim 18 wherein the carrier particles are comprised of a steel core coated with a polymer selected from the group consisting of polychlorotrifluoroethylene-co-vinylchloride copolymer, a polyvinylidene fluoropolymer, a terpolymer of styrene, methacrylate, and vinyltriethoxysilane, fluorinated ethylene-propylene copolymers, and polytetrafluoroethylene.

20. A developer composition in accordance with claim 18 wherein the resin particles for the toner composition are selected from the group consisting of polyesters, styrene butadiene copolymers, strene acrylates, and styrene methacrylate copolymers.

21. A developer composition in accordance with claim 20 wherein the polyester results from the condensation reaction of dimethylterephthalate, 1,3-butanediol, and pentaerythritol.

22. A developer composition in accordance with claim 20 wherein the styrene butadiene copolymer contains 89 percent by weight of styrene, and 11 percent by weight of butadiene.

23. A developer composition in accordance with claim 20 wherein there is selected a suspension polymerized styrene butadiene resin.

24. A developer composition in accordance with claim 18 wherein the pigment for the toner is selected from the group consisting of carbon black, magnetite, and mixtures thereof.

25. A developer composition in accordance with claim 18 wherein the pigment for the toner is selected from the group consisting of magenta, cyan, yellow, and mixtures thereof.

26. A developer composition in accordance with claim 18 wherein the toner contains a charge enhancing additive.

27. A developer composition in accordance with claim 26 wherein the charge enhancing additive is selected from the group consisting of distearyl dimethyl ammonium methyl sulfate, cetyl pyridinium halides, and stearyl phenethyl dimethyl ammonium tosylate.

28. A method of imaging which comprises forming a latent image on a photoconductive member; thereafter developing the image with the composition of claim 1; subsequently transferring the image to a suitable substrate; and permanently affixing the image thereto.

29. A method of imaging which comprises forming a latent image on a photoconductive member; thereafter developing the image with the composition of claim 2; subsequently transferring the image to a suitable substrate; and permanently affixing the image thereto.

30. A method of imaging in accordance with claim 28 wherein a silicone fuser roll is selected for affixing the image.

31. A method of imaging in accordance with claim 29 wherein a silicone fuser roll is selected for affixing the image.

* * * * *